US012258174B2

(12) United States Patent
Vermeulen

(10) Patent No.: US 12,258,174 B2
(45) Date of Patent: Mar. 25, 2025

(54) GUIDING RAIL AND TRANSPORT CONTAINER

(71) Applicant: CONTEYOR INTERNATIONAL NV, Merelbeke (BE)

(72) Inventor: Bart Vermeulen, Ghent (BE)

(73) Assignee: CONTEYOR INTERNATIONAL NV, Merelbeke (BE)

( * ) Notice: Subject to any disclaimer, the term of this patent is extended or adjusted under 35 U.S.C. 154(b) by 519 days.

(21) Appl. No.: 17/435,444

(22) PCT Filed: Mar. 9, 2020

(86) PCT No.: PCT/EP2020/056154
§ 371 (c)(1),
(2) Date: Sep. 1, 2021

(87) PCT Pub. No.: WO2020/178454
PCT Pub. Date: Sep. 10, 2020

(65) Prior Publication Data

US 2022/0055796 A1 Feb. 24, 2022

(30) Foreign Application Priority Data

Mar. 7, 2019 (DE) ..... 20 2019 001 052.1
Jul. 22, 2019 (DE) ..... 20 2019 104 028.9

(51) Int. Cl.
*B65D 19/06* (2006.01)
*A47F 5/08* (2006.01)
(Continued)

(52) U.S. Cl.
CPC ..... *B65D 19/06* (2013.01); *B65D 19/38* (2013.01); *B65D 25/005* (2013.01);
(Continued)

(58) Field of Classification Search
CPC ..... B65D 19/06; B65D 19/38; B65D 25/005; B65D 2519/00338; B65D 2519/00805; A47F 5/0843
(Continued)

(56) References Cited

U.S. PATENT DOCUMENTS 9,010,563 B2 4/2015 Bradford et al.
9,016,507 B2 * 4/2015 Bradford ..... B65D 88/546 220/544
(Continued)

FOREIGN PATENT DOCUMENTS

DE 19535013 A1 4/1996
DE 202005005489 U1 6/2005
(Continued)

OTHER PUBLICATIONS

ISR-WO dated Jun. 18, 2020 for parent application PCT/EP2020/056154.

*Primary Examiner* — J. Gregory Pickett
*Assistant Examiner* — Niki M Eloshway
(74) *Attorney, Agent, or Firm* — Vorys, Sater, Seymour and Pease LLP

(57) ABSTRACT

In a first aspect, the invention concerns a guiding rail comprising a guiding channel having a slit opening. The guiding rail is further provided with one or more sliding elements, and a blocking element coupled to the guiding rail. In particular, a blocking portion of the blocking element is movable between first and second positions. In further aspects, the invention discloses a transport container provided with such guiding rails, and a blocking element for such guiding rails.

10 Claims, 6 Drawing Sheets

(51) Int. Cl.
*B65D 19/38* (2006.01)
*B65D 25/00* (2006.01)

(52) U.S. Cl.
CPC ..... *A47F 5/0846* (2013.01); *A47F 5/0853* (2013.01); *B65D 2519/00338* (2013.01); *B65D 2519/00805* (2013.01); *B65D 2519/0082* (2013.01)

(58) Field of Classification Search
USPC ..... 220/533
See application file for complete search history.

(56) References Cited

U.S. PATENT DOCUMENTS

| | | | | |
|---|---|---|---|---|
| 2013/0057135 | A1 | 3/2013 | Bradford | |
| 2015/0136634 | A1* | 5/2015 | Bradford | B65D 81/05 206/521 |
| 2015/0136787 | A1 | 5/2015 | Bublitz | |
| 2016/0114970 | A1* | 4/2016 | Bradford | B65D 88/546 220/544 |
| 2020/0180837 | A1* | 6/2020 | Burns | B65D 85/68 |
| 2020/0198835 | A1* | 6/2020 | Burns | B65D 19/08 |

FOREIGN PATENT DOCUMENTS

| | | | |
|---|---|---|---|
| WO | 2017076516 | A1 | 5/2017 |
| WO | 2020178454 | A1 | 9/2020 |

* cited by examiner

GUIDING RAIL AND TRANSPORT CONTAINER

TECHNICAL FIELD

The invention pertains to the technical field of flexible dunnage systems for transport and storage of goods. In particular, the invention relates to guiding rails for supporting such flexible dunnage systems.

BACKGROUND

Transport and storage containers having movable dunnage are considered to be well-known. The dunnage may provide pockets for accommodating goods during transport/storage. Typically, the dunnage is suspended from sliding elements, and slidable along guiding rails.

U.S. Pat. No. 9,010,563, for instance, describes a shipment container having U-shaped pockets of dunnage. The container comprises a metal frame. The frame is further provided with tracks on opposite sides of the container. Slider bars extend between the tracks, wherein nylon slider heads enhance slidable movement of the slider bars along the tracks. Some tracks further have a cut-out portion. This may allow for the removal of damaged sliders from the tracks, and/or for the insertion of replacement sliders. When in use, the cut-out portions are covered by means of dedicated caps.

WO 2017 076 516 further describes a transport container having a self-supportive dunnage structure. The dunnage is suspended from sliding elements, wherein each sliding element is slidably engaged within a recess of a guiding rail. The guiding rail may further be provided with a polymer insert. This lowers friction. In order to prevent the sliding elements from escaping the guiding rails, the ends of the latter are covered by means of end caps. A portion of the guiding rail may be "insert-free", thereby allowing insertion of the sliding elements. When in use, however, further blocking elements must be mounted onto such insert-free portions of the guiding rail.

Important characteristics of containers for transport and storage generally relate to ergonomics, durability, ease of assembly, and foldability. In particular, their contribution to the overall efficiency of logistics is of key importance.

It is further preferred that the containers do not have sharp edges or protruding parts. These might damage the goods, and these might hinder loading/unloading. Complex designs comprising mountable/demountable parts (e.g. separate caps or separate, mountable/demountable blocking elements) are to be avoided. In addition, their design should preferably allow for replacing container parts. This is especially advantageous for parts that are particularly subject to wear.

The present invention aims to provide a novel and improved guiding rail for transport containers. An further object is to solve one or more of the above-mentioned problems.

SUMMARY OF THE INVENTION

To such end, a guiding rail according to claim 1 is provided. The latter has a blocking element featuring a blocking portion that is movable between a first position and a second position. On the one hand, the blocking portion will in its first position obstruct a passage for the sliding elements. It may for instance prevent a sliding element from unintentionally escaping the guiding channel. On the other hand, the blocking portion may allow a passage for the sliding elements, in its second position. The invention thus advantageously provides a blocking element that selectively controls a passage of sliding elements, within the guiding channel.

DETAILED DESCRIPTION OF THE INVENTION

Figure 1A:
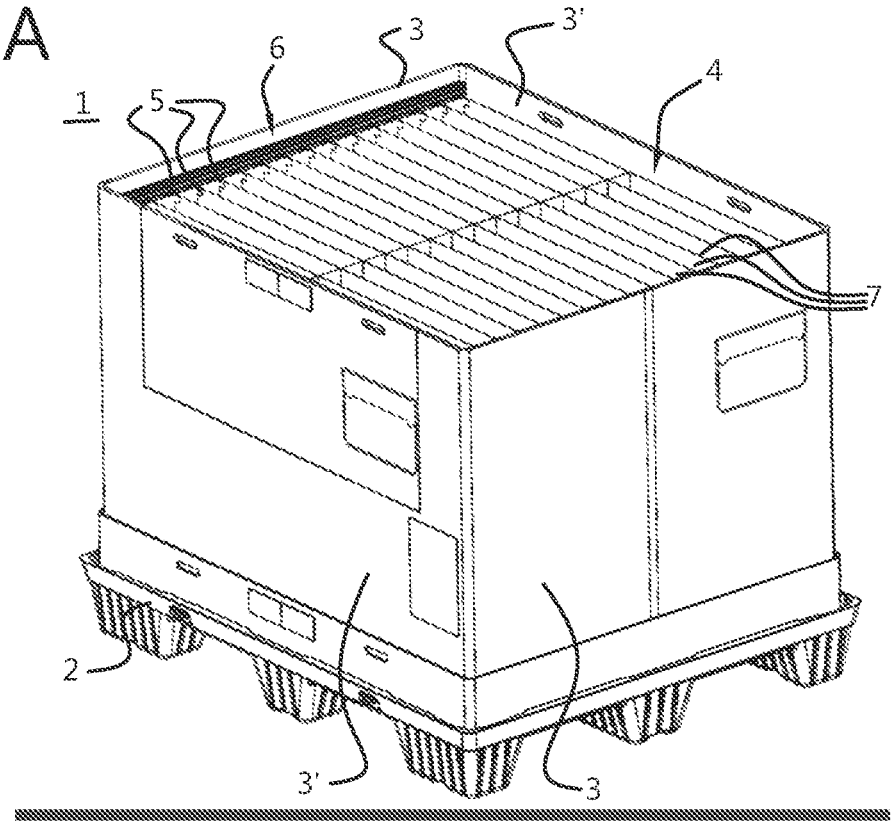
FIG. 1A gives a perspective view on a container for transport and/or storage of goods, according to a possible embodiment of the invention.

The present invention concerns a guiding rail for supporting movable dunnage structures within transport/storage containers, a container as such, and a blocking element for such guiding rails.

Unless otherwise defined, all terms used in disclosing the invention, including technical and scientific terms, have the meaning as commonly understood by one of ordinary skill in the art to which this invention belongs. By means of further guidance, term definitions are included to better appreciate the teaching of the present invention.

As used herein, the following terms have the following meanings:

"A", "an", and "the" as used herein refers to both singular and plural referents unless the context clearly dictates otherwise. By way of example, "a compartment" refers to one or more than one compartment.

"About" as used herein referring to a measurable value such as a parameter, an amount, a temporal duration, and the like, is meant to encompass variations of +/−20% or less, preferably +/−10% or less, more preferably +/−5% or less, even more preferably +/−1% or less, and still more preferably +/−0.1% or less of and from the specified value, in so far such variations are appropriate to perform in the disclosed invention. However, it is to be understood that the value to which the modifier "about" refers is itself also specifically disclosed.

"Comprise", "comprising", and "comprises" and "comprised of" as used herein are synonymous with "include", "including", "includes" or "contain", "containing", "contains" and are inclusive or open-ended terms that specifies the presence of what follows e.g. component and do not exclude or preclude the presence of additional, non-recited components, features, element, members, steps, known in the art or disclosed therein.

The recitation of numerical ranges by endpoints includes all numbers and fractions subsumed within that range, as well as the recited endpoints.

The term "dunnage" further may refer to an assembly of one or more pockets mounted in a transport/storage container. Preferably the dunnage is movable. Such dunnage may be suspended between a set of guiding rails, for instance by means of a solid support bar that features sliding elements at both end portions. Alternatively, the dunnage may be self-supportively suspended from a plurality of sliding elements, engaged within said guiding rails. Such flexible, freely-supported dunnage is highly convenient for the design of foldable containers. In any case, the dunnage is preferably "movable", through slidability of the sliding elements along the guiding rails.

Among other things, the present invention concerns an improved guiding rail which can be used in such transport and/or storage containers.

In a first aspect, the invention concerns a guiding rail comprising a guiding channel having a slit opening, which guiding rail is further provided with:

- one or more sliding elements engaged within said channel, wherein the sliding elements are able to slide back and forth along said channel while providing a support through the slit opening, suitable for supporting a dunnage structure in a transport and/or storage device, and
- a blocking element coupled to the guiding rail, which blocking element has a blocking portion for blocking a passage of the sliding elements along said channel.

In particular, the blocking element is further adapted for its blocking portion to be movable between a first position and a second position, in which the blocking portion respectively blocks and allows said passage of the sliding elements.

The guiding rail preferably extends into a "longitudinal direction". The guiding rail may thereby have a transverse cross-section, mostly invariant between its two end portions. Any "transverse direction" w.r.t. the guiding rail may refer to a direction comprised in a plane perpendicular to said longitudinal direction. The guiding rail may comprise an extruded rail profile. For example, the guiding rail may comprise an aluminum or composite extruded rail profile.

In any case, the guiding rail further comprises or embraces a so-called guiding channel. According to a non-limiting example, the transverse cross-section of the guiding rail may comprise two arms embracing such a guiding channel. Said arms are further parted by a slit opening. For instance, the guiding rail may comprise a substantially U-shaped or C-shaped transverse cross-section.

One or more sliding elements, and preferably a plurality of sliding elements is engaged within the guiding channel. They are able to slide back and forth along said channel. Simultaneously, they provide a support through the slit opening. For instance, one or more dunnage straps may extend towards the guiding channel, where they are coupled to sliding elements provided within said channel. In another example, a portion of the sliding element may extend through the slit opening, providing an exterior eyelet. The invention is not limited to any of these.

The sliding elements may be slidably fitted in the rail. "To be slidably fitted in a rail" means that an element is fitted in the rail. At the same time, it is able to slide along a guiding channel formed by the rail. Of course, a certain tolerance may apply to the sliding element dimensions. The sliding elements may be fitted directly into the guiding channel. As an alternative, the sliding elements may be fitted into an "intermediate material" that is provided within the guiding channel. Such an intermediate material may for instance comprise an insert, as described below.

The guiding rail is further provided with a blocking element. The latter is coupled to the guiding rail. The blocking element may be releasably coupled to the guiding rail (e.g. via threaded fasteners, snap-fit, clamping action, . . . ). As an alternative, the blocking element may be permanently coupled to the guiding rail (e.g. via gluing, multi-component molding, . . . ). Preferably when in normal operation, the blocking element remains coupled to the guiding rail. In particular, moving its blocking portion between the first and second positions does preferably not interfere with the blocking element being coupled to the guiding rail.

The blocking portion of the blocking element is movable between "a first position" and "a second position". On the one hand, the blocking portion will in its first position obstruct a passage of the sliding elements. It may for instance prevent a sliding element from unintentionally escaping the guiding channel. For instance, it may block a passage towards a zone where the sliding elements can be removed from the guiding channel. On the other hand, the blocking portion may equally allow a passage of the sliding elements, in its second position. The invention thus advantageously provides a blocking element that may selectively control the passage of sliding elements, within the guiding channel. In a particularly preferred embodiment, the sliding elements are replaceable. For instance, sliding elements may be subject to wear, especially when the dunnage is used for accommodating respectively heavy goods. The present invention may thereby allow for selectively extracting sliding elements from the guiding rail.

The blocking element may or may not extend into the guiding channel. The blocking portion may or may not be positioned within the guiding channel, in its first and/or second positions. The blocking element may or may not be integrally formed. The blocking portion is preferably movable (e.g. through sliding motion, pivotal motion, bending, . . . ) with respect to at least one further portion of the blocking element.

In a further or alternative embodiment, the blocking element is adapted for its blocking portion to be movable in a substantially transverse direction w.r.t. the guiding rail, between its first and second positions. These positions may have a substantially different transverse location w.r.t. the guiding rail. The corresponding motion of the blocking portion may comprise a transverse component of movement. However, the movement of the blocking portion need not necessarily be strictly transverse. It may comprise an inclined transverse-longitudinal motion.

In any case, a substantially transverse motion is substantially perpendicular to the longitudinal direction. The blocking portion may therefore efficiently block the passage of sliding elements that are forced to slide along the longitudinal direction.

In particular, these sliding elements may not force the blocking portion to move substantially transversely, into its second (non-blocking) position.

In a further or alternative embodiment, the blocking element is adapted for its blocking portion to be resiliently movable between a relaxed position and a tensed position. These preferably correspond to the first blocking and second non-blocking positions respectively. The blocking portion will thus automatically return to its relaxed blocking position.

In a further or alternative embodiment, the blocking element comprises a resilient member. In a further or alternative embodiment, the blocking element comprises a resilient lip. In a further or alternative embodiment, the blocking element comprises a pivotable lip. The lip may be resiliently pivotable. Additionally or alternatively, the lip may be resiliently bendable. An advantage of such a lip, is that the blocking element can be integrally formed. In a non-limiting embodiment, the blocking element is obtained via injection molding.

In a further or alternative embodiment, the blocking element comprises a lever for actuating the blocking portion to move between the first position and the second position. As such, the blocking portion can be easily operated to selectively block and/or unblock a passage of the sliding elements.

In a further or alternative embodiment, the guiding rail further has an engagement opening for engaging sliding elements within the guiding channel, and/or for disengaging sliding elements from the guiding channel. The blocking portion may selectively block a passage of the sliding elements towards a zone of the guiding rail in which latter engagement opening is provided.

In a further or alternative embodiment, the engagement opening is arranged in a transverse direction w.r.t. the guiding rail. An advantage is that the sliding elements can be transversely engaged with, and disengaged from the guiding channels. For instance, sliding elements may still be replaced in containers having front and back sides that cover the end portions of the guiding rails. There is no need for disassembling the container sides.

The engagement opening may or may not be arranged as a widening of the slit opening. For instance, the engagement opening may be formed by a cut-out, extending from the slit opening and through a side wall and/or upper wall of the guiding rail.

In a further or alternative embodiment, the blocking element is adapted for its blocking portion to be resiliently moveable, away from said engagement opening, between a first relaxed position and a second tensed position. Preferably, upon passing the sliding element through the engagement opening, the blocking portion is forced away from the engagement opening, against the resilient force. In doing so, the passage for the sliding element is automatically cleared. It is therefore highly straightforward to engage sliding elements within the guiding channel. At the same time, unintentional escape of sliding elements from the guiding channel is prohibited.

In a further or alternative embodiment, the guiding rail is provided with a friction reducing insert, within the guiding channel. The insert need not cover the entire length of the guiding channel. The insert may comprise one or more portions. In particular, the insert may comprise a division as described in WO 2017 076 516.

Preferably, the insert comprises or embraces a so-called insert channel. The sliding elements may be engaged within latter channel. The sliding elements may be slidably fitted into the insert channel. The insert may comprise two arms, parted by an insert slit opening, and enclosing the sliding elements within the insert channel. Preferably, the insert thereby inhibits removal of the sliding elements from the insert channel, through its slit opening. Latter slit opening is sufficiently narrow. The guiding rail and insert preferably have a cross-section which is substantially invariant over the longitudinal direction. For instance, the guiding rail comprises an aluminum extruded profile, while its guiding channel is provided with a polymer insert.

The insert may or may not comprise a polymer. According to a non-limiting embodiment, the insert comprises a polymer selected from polyolefins such as high-density polyethylene (HDPE), ultra-high-molecular-weight polyethylene (UHMWPE), medium density polyethylene (MDPE), polypropylene, polyurethane, polystyrene, cross-linked polyethylene (PEX or XLPE), polyoxymethylene (POM), or lubricated or modified versions of any of the polyolefins stated above to create lower friction coefficients.

Preferably, the engagement opening is arranged as a cut-off and/or as a cut-out of said insert. Such a cut-off or cut-out may define an termination and/or interruption of the insert, within the guiding channel. At the level of said termination/interruption, the guiding rail may provide a slit opening that is sufficiently wide for the sliding elements to be engaged and/or disengaged. The guiding rail thus provides an engagement opening, at the level of said termination/interruption.

In a further or alternative embodiment, the blocking element is coupled to an open end portion of the guiding rail. The blocking element may thus form an end cap. Such blocking element may further cover any sharp edges (e.g. burs due to cutting processes) of the rail profile. This is very useful, since it might by quite cumbersome to deburr rail profiles that have a particularly complex cross-section.

In a further or alternative embodiment, the guiding rail has a guiding channel and at least one anchorage channel, both extending into the longitudinal direction of the rail. The blocking element is thereby provided to an open end portion of the guiding rail. It has at least one expansion anchor. The latter provides a coupling of the blocking element into the anchorage channel, by means of a threaded fastener. In particular, the expansion anchor has transversely expanded, within the anchorage channel.

In a second aspect, the invention concerns a container for transport and/or storage of goods, the container comprising:

- a bottom and at least two sides, erecting from said bottom,
- at least one pair of opposite guiding rails supported by the container sides,
- a plurality of sliding elements, engaged with guiding channels formed by said guiding rails, and
- a dunnage structure that is suspended from the sliding elements.

In particular, said guiding rails correspond to the guiding rail as described above. The same characteristics and advantages may thus apply. In particular, such a container can be conveniently assembled, and its sliding elements can be replaced.

In a third aspect, the invention concerns a blocking element, suitable for being provided to an open end portion of a guiding rail having a guiding channel, which channel extends into a longitudinal direction of the rail, said blocking element comprising:

- a transverse cover for at least partly covering the guiding channel at said open end portion,
- a blocking portion positioned at an inner side w.r.t. the cover, which blocking portion is suitable for extending into the guiding channel, and for blocking a passage of sliding elements engaged within said channel.

In particular, the blocking element is further adapted for its blocking portion to be movable between a first position and a second position, for respectively blocking and allowing said passage of the sliding elements. The blocking element may correspond to the blocking element as described above. The corresponding characteristics and advantages may thus be repeated.

In a further or alternative embodiment, the guiding rail additionally has an anchorage channel, equally extending into the longitudinal direction of the rail. In particular, the blocking element further comprises an expansion anchor extending longitudinally from the inner side of the cover, which anchor is suitable for extending into the anchorage channel, and which anchor is further adapted for receiving a threaded fastener, upon which said anchor is configured for transversely expanding. Advantageously, this allows an easy assembly via straightforward coupling of the blocking element to the guiding rail.

In a further aspect, the invention may provide a method for engaging a sliding element within a guiding channel of a guiding rail, wherein the sliding element is able to slide back and forth along said channel while providing a support through a slit opening of the rail, which method comprises passing an engagement portion of the sliding element (i) through an engagement opening formed by the rail, and (ii) past a blocking portion of a blocking element coupled to said rail. In particular, said blocking portion is moved from a first position, in which said blocking portion blocks said passage, into a second position, in which said blocking portion allows said passage of the sliding element. The guiding rail and/or blocking element may further correspond to what is described above. The same characteristics and advantages may therefore apply.

In a further aspect, the invention may provide a method for disengaging a sliding element from a guiding channel of a guiding rail, wherein the sliding element is able to slide back and forth along said channel while providing a support through a slit opening of the rail, which method comprises passing an engagement portion of the sliding element (i) past a blocking portion of a blocking element coupled to the rail, and (ii) through an engagement opening formed by said rail. In particular, said blocking portion is moved from a first position, in which said blocking portion blocks said passage, into a second position, in which said blocking portion allows said passage of the sliding element. The guiding rail and/or blocking element may further correspond to what is described above. The same characteristics and advantages may therefore apply.

In particular, for engaging or disengaging a sliding element from the guiding rail, the blocking element may be operated for its blocking portion to move against resilience, from its first blocking position into its second non-blocking position.

The invention is now further described by the following, non-limiting examples and figures which further illustrate the invention, and which are not intended to, nor should they be interpreted to, limit the scope of the invention.

FIG. 1A gives a perspective view on a container 1 for transport and/or storage of goods, according to a possible embodiment. The container 1 has a bottom 2 and four sides 3, 3, 3', 3', erecting from said bottom 2. The interior of the container 1 is further provided with a dunnage structure 4. The latter may provide a plurality of pockets 7 for accommodating the goods during transport and/or storage. The dunnage structure 4 is suspended from sliding elements 5. As such, the dunnage structure 4 is movable, wherein the sliding elements 5 are slidably engaged with a pair of opposite guiding rails 6. The guiding rails 6 themselves are supported by two opposite container sides 3, 3.

Figure 1B:
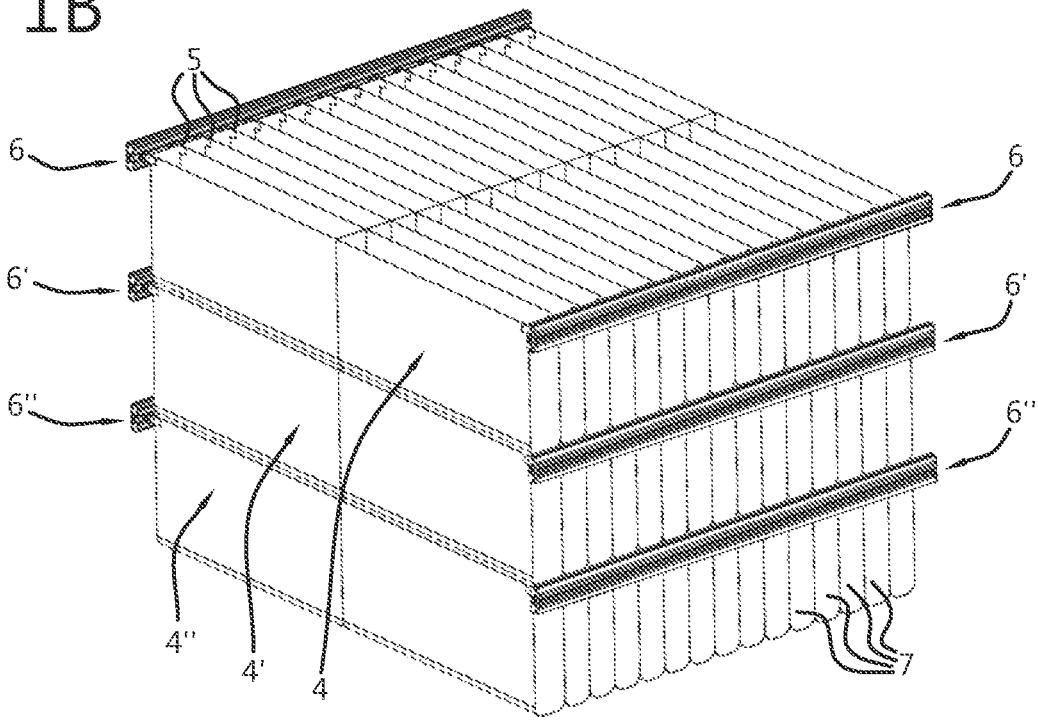
FIG. 1B further gives a perspective view on possible dunnage structures and corresponding sets of guiding rails, compatible with the container of FIG. 1A.

FIG. 1B further gives a perspective view on possible dunnage structures 4, 4', 4" and corresponding sets of guiding rails 6, 6', 6", compatible with the container 1 of FIG. 1A. The container bottom 2 and sides 3, 3, 3', 3' are omitted from the figure. As can be seen, there are three levels of dunnage 4, 4', 4". Each level is suspended from a plurality of sliding elements 5, slidably engaged within respective pairs of opposite guiding rails 6, 6', 6".

Figure 2A:
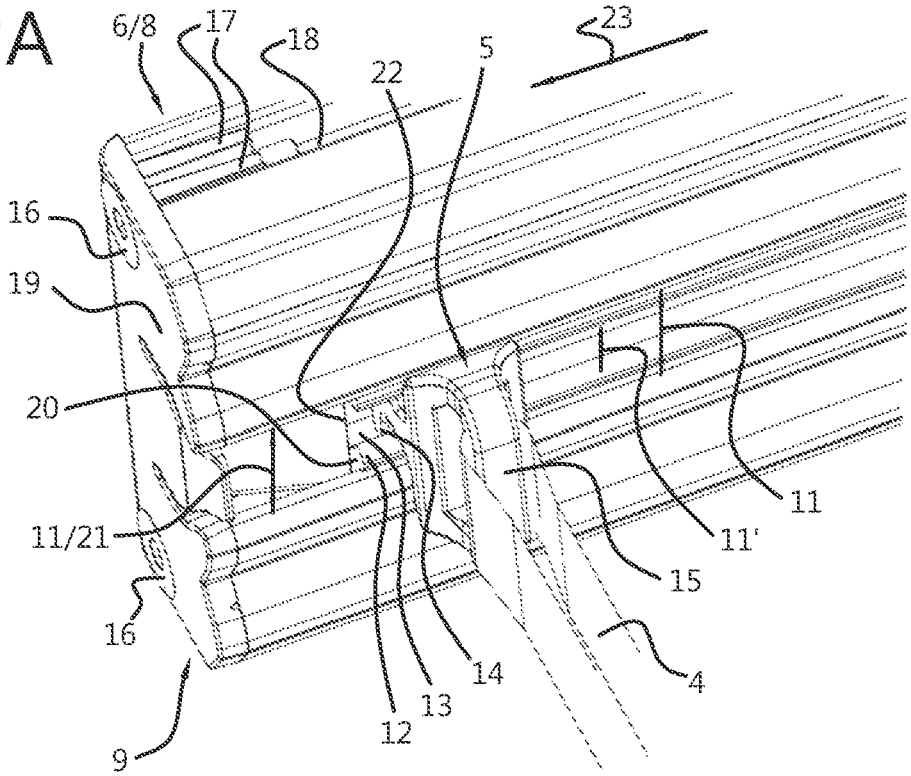
FIGS. 2A-B give a perspective view of an embodiment of the guiding rail, further provided with an insert, a sliding element and a blocking element; the guiding rail itself has been omitted from FIG. 2B.
Figure 2B:
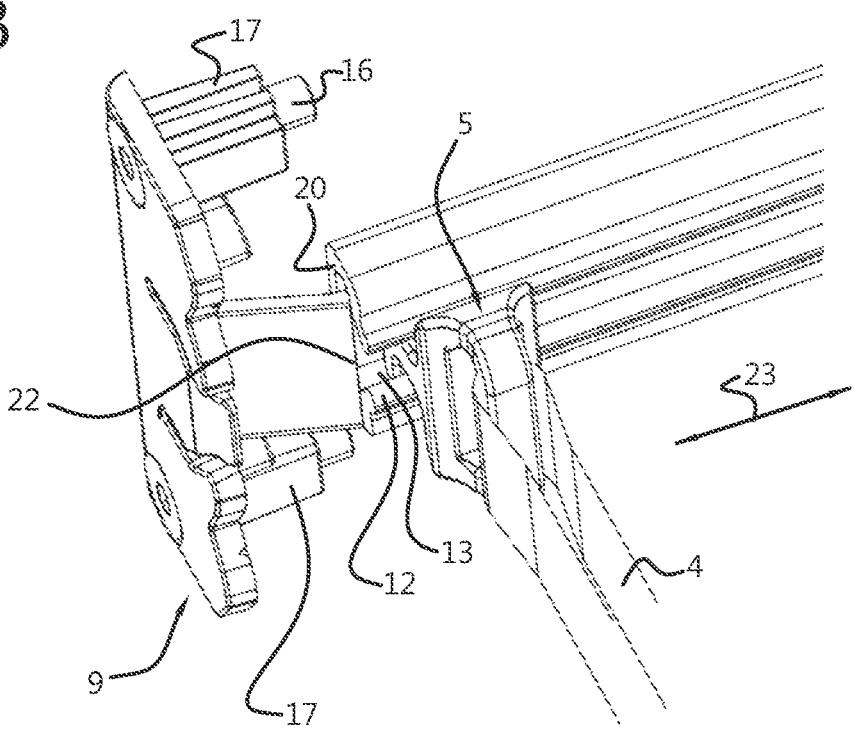

FIGS. 2A-B give a perspective view on an end portion 8 of a possible guiding rail 6, further provided with a sliding element 5 and a blocking element 9; the guiding rail 6 itself has been omitted from FIG. 2B. The guiding rail 6 forms a longitudinal guiding channel 10 (not indicated), having a slit opening 11. The blocking element 9, coupled to the open end portion 8, further comprises a transverse cover 19. As such, it covers the guiding channel 10 at said end portion 8. The blocking element 9 further has two expansion anchors 17 (only one of which is visible in FIG. 2A). These extend into two corresponding anchorage channels 18 (only one of which is visible in FIG. 2A), formed by the guiding rail 6. The expansion anchors 17 have expandable sleeves. They are further adapted for receiving threaded fasteners 16, in which they expand outwardly and transversely. The expansion anchors 17 thus provide a coupling mechanism.

A friction reducing insert 12 is further provided within said guiding channel 10. Latter insert 12 forms an insert channel 13, equally having a slit opening 11'. At least one sliding element 5 is slidably engaged within insert channel 13 (and thus also within the guiding channel 10). To such end, the sliding element 5 is provided with an engagement portion 14. The sliding element 5 is thus able to move back and forth along the longitudinal direction 23, along the guiding channel 10. The sliding element 5 simultaneously provides a support 15 for the dunnage 4, through the aforementioned slit openings 11, 11'. Preferably, the insert slit opening 11' is sufficiently narrow for retaining the sliding elements 5. As such, it does not allow for disengaging sliding elements 5 from the insert channel 13.

However, the insert 12 does not extend over the entire length of the guiding rail 6. It has a cut-off 20. Additionally, in the embodiment shown, the slit opening 11 of the guiding channel 10 is wider than the slit opening 11' of the insert channel 13. By providing a wider opening, the slit opening 11 of the guiding channel 10 may allow for engaging and disengaging the sliding elements 5. See for instance FIG. 3D. As such, the guiding channel 10 slit opening 11 provides an engagement opening 21 at/beyond said cut-off 20. The cut-off 20 is more clearly visible in FIG. 2B, in which the guiding rail 6 has been omitted.

As shown in FIG. 2A-B, the blocking element 9 has a blocking portion 22 that blocks a passage of the sliding element 5. More particularly, it prohibits the sliding element 5 to slide past the cut-off 20, where the engagement opening 21 is arranged. As such, the sliding element 5 cannot be disengaged, unless the blocking portion 22 is moved from its first position (shown in FIG. 2A-B) into a second position, in which it allows said passage. See for instance the embodiment of FIG. 3A-B.

Figure 5:
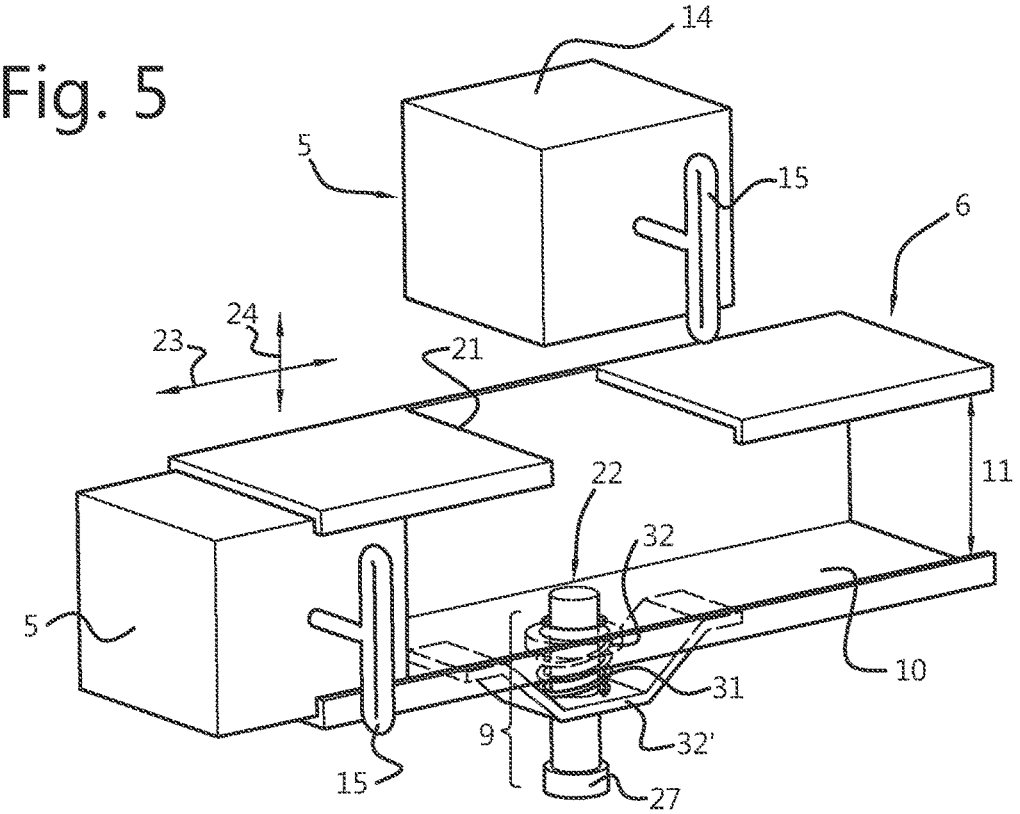
FIG. 5 illustrates an alternative embodiment of the guiding rail and sliding elements.

In general, for engaging/disengaging a sliding element 5, the blocking element 9 preferably remains coupled to the guiding rail 6. At the same time, it is designed such that its blocking portion 22 can be moved into a second, non-blocking position. A number of possible (and non-limiting) mechanisms is shown in FIG. 3A-B, FIG. 5, and in FIG. 6.

Figure 3A:
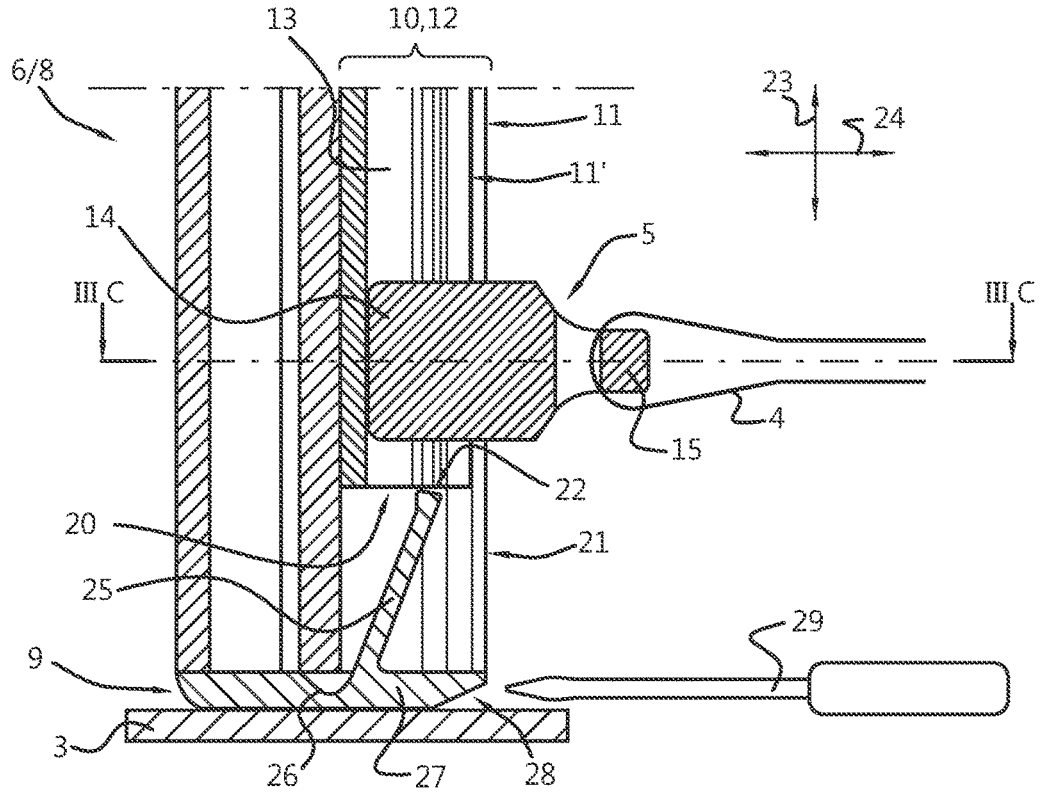
FIGS. 3A-B each depict a horizontal cut of a guiding rail end portion, according to a possible embodiment of the invention.
Figure 3B:
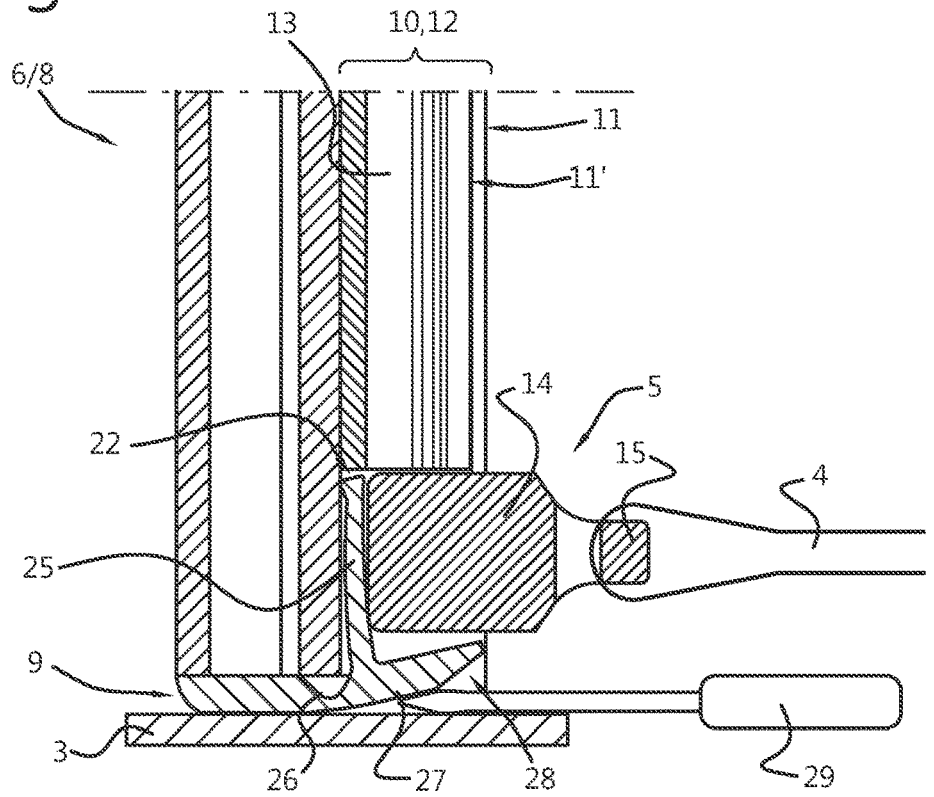

FIGS. 3A-B each depict a horizontal cut of a guiding rail 6 end portion 8, according to a possible embodiment. The latter may correspond to the embodiment of FIG. 2A-B. The guiding rail 6 comprises a guiding channel 10 having a slit opening 11. An insert 12 is further provided within the guiding channel 10. Latter insert 12 comprises an insert channel 13, also having a slit opening 11'. A sliding element 5 is now slidably engaged within the insert channel 13, via its engagement portion 14. The sliding element 5 may simultaneously provide a support 15 for dunnage 4, through both slit openings 11, 11'.

The insert 12 has a cut-off 20. The guiding rail 6 thereby provides an engagement opening 21. The latter is positioned at and beyond this cut-off 20. However, due to a blocking element 9 present on the guiding rail 6, sliding elements 5 cannot be disengaged from the insert channel 13 by coincidence. Indeed, the blocking element 9 features a blocking portion 22. The blocking portion 22 is normally positioned in a first, blocking position (see FIG. 3A). As such, it blocks the passage of the sliding element 5; it prevents the engagement portion 14 of the sliding element 5 from exiting the insert channel 13, in which they may subsequently pass through the engagement opening 21.

However, the blocking element 9 is further adapted for its blocking portion 22 to be movable between a first position (see FIG. 3A) and a second position (see FIG. 3B). In the embodiment of FIG. 3A-B, the blocking portion is formed by a lip 25. Said lip 25 may qualify as a resilient and/or pivotable member. In particular, the blocking element 5 of FIG. 3A-B is provided with a groove 26, near the base of the lip 25. This groove 26 provides a weakening. The lip 25 may therefore be pivoted, wherein the blocking portion 22 is moved from its first position into its second position. Additionally or alternatively (not shown in FIG. 3A-B), the lip 25 may be sufficiently thin, such that it is resiliently bendable. As can be seen from FIG. 3A-B, the blocking portion 22 is moved in a substantially transverse direction 24 w.r.t. the guiding rail, between its first and second positions. FIG. 3A shows the lip 25 and blocking portion 22 in their first, relaxed position. FIG. 3B shows the lip 25 and blocking portion 22 in their second, tensed position.

In order to disengage the sliding element 5 from the guiding rail 6, the blocking portion 22 is moved into its second position. To such end, the blocking element 5 may comprise a lever 27. An outward edge 28 of said lever 27 is preferably chamfered. As schematically shown in FIG. 3B, a fine tool (e.g. a flat-blade screwdriver 29) may thus be forced in between the lever 27 and an adjacent structure—e.g. a container front side 3, referring back to FIG. 1A. This action causes the lever 27 and lip 25 to pivot within the guiding channel 10. The blocking portion 22 is thus moved away from the engagement opening 21, from its first position into its second position. Passage of the sliding element 5 is now allowed. Once it has exited the insert channel 13, the engagement portion 14 of the sliding element 5 may simply be removed from the guiding rail 6, through the engagement opening 21. This may or may not involve an unhooking movement, as shown in FIG. 3D.

Conversely, in order to engage the sliding element 5 within the guiding rail, the blocking portion 22 is equally moved into its second position. For instance, the engagement portion 14 of the sliding element 5 may simply inserted into the guiding rail 6, through the engagement opening 21. This may or may not involve a hooking movement, as shown in FIG. 3D. In doing so, the blocking portion 22 of the blocking element 9 is pushed away from the engagement opening 21; it is pushed into its second position. Only optionally the lever 27 is employed. It is now possible to slide the engagement portion 14 into the insert channel 13. The sliding element 5 is now engaged within the guiding channel 10 and insert channel 13.

Figure 3C:
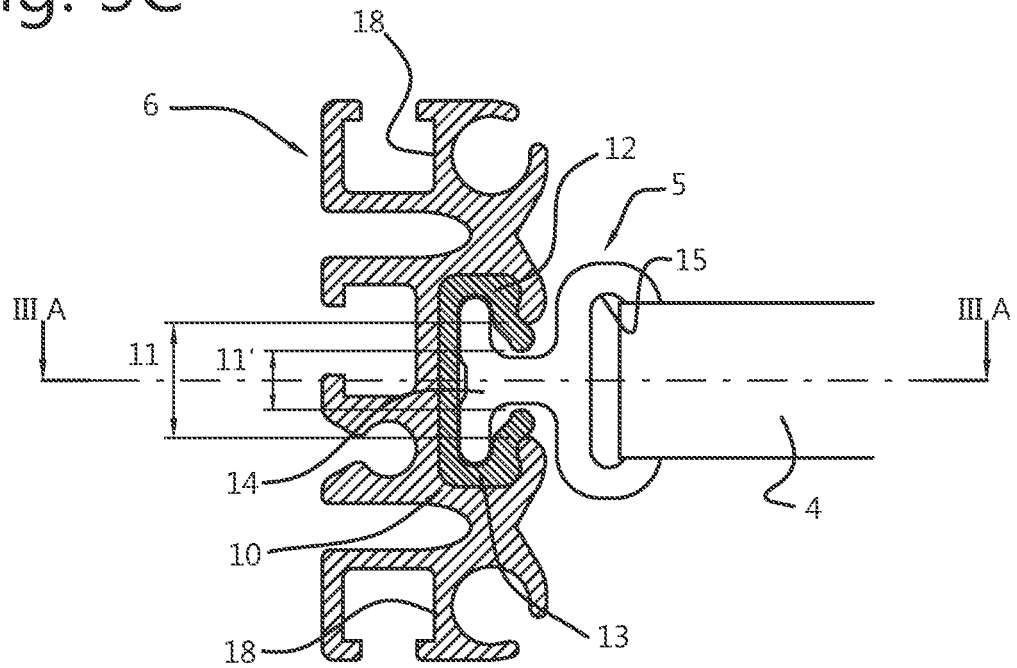
FIGS. 3C-D show transverse cross-sections of the guiding rail according to FIG. 2A-B, and according to FIG. 3A-B.
Figure 3D:
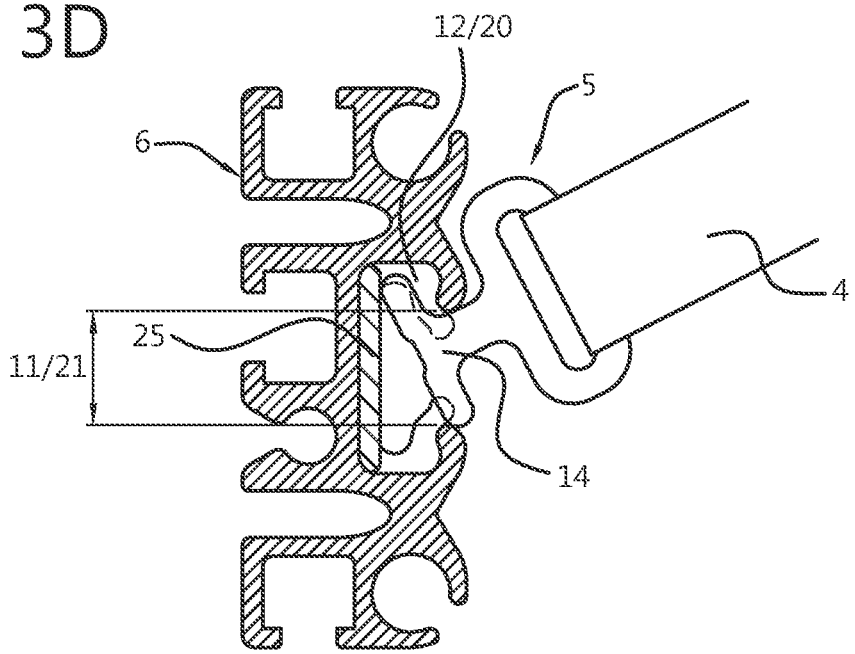

FIGS. 3C-D show transverse cross-sections of the guiding rail 6 according to FIG. 2A-B, and according to FIG. 3A-B.

In FIG. 3C, the cross-section passes through an insert 12 that is provided within the guiding rail 6. Sliding elements 5 are engaged within the insert channel 13. One sliding element 5 is shown in particular. The cross-section plane of the figure thereby additionally passes through the sliding element (not indicated on the figure for reasons of clarity).

In FIG. 3D, the cross-section passes through the guiding rail 6 only (and not through the insert 12), at the level of a termination/interruption of the insert 12. The cross-section thus provides a view on the insert 12 cut-off 20. The engagement portion 14 of the sliding element 5 is slid past the blocking portion 22 (see FIG. 3B), beyond the insert 12 cut-off 20. As was the case in FIG. 3C, the sliding element 5 is positioned at cross-section level of the figure. Its engagement portion 14 is now hooking into/unhooking from the engagement opening 21.

"Transverse cross-section", as generally used herein, denotes that the cross-section is taken perpendicularly to the "longitudinal direction" of the guiding rail 6. All directions contained within such a transverse cross-section are referred to as "transverse directions".

Figure 4A:
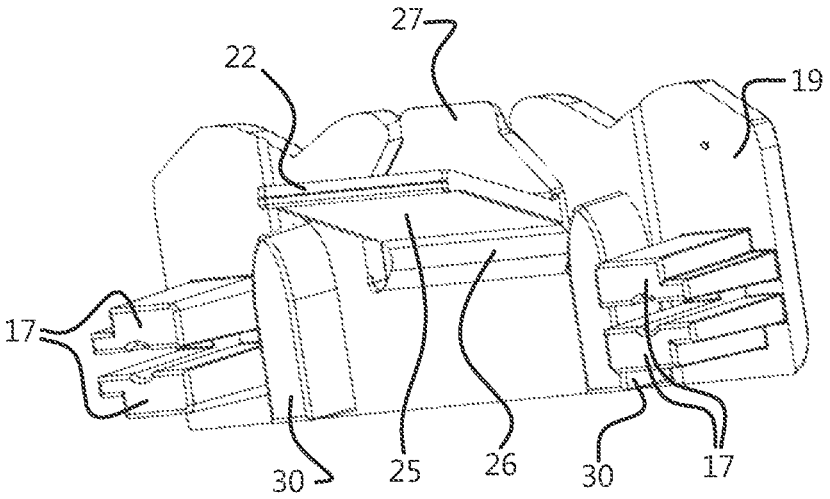
FIGS. 4A-C give perspective views on a separate/decoupled blocking element, according to a possible embodiment of the invention.
Figure 4B:
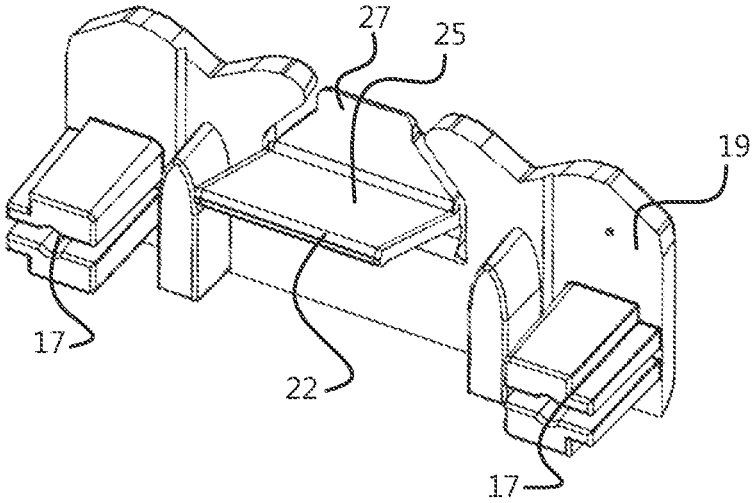
Figure 4C:
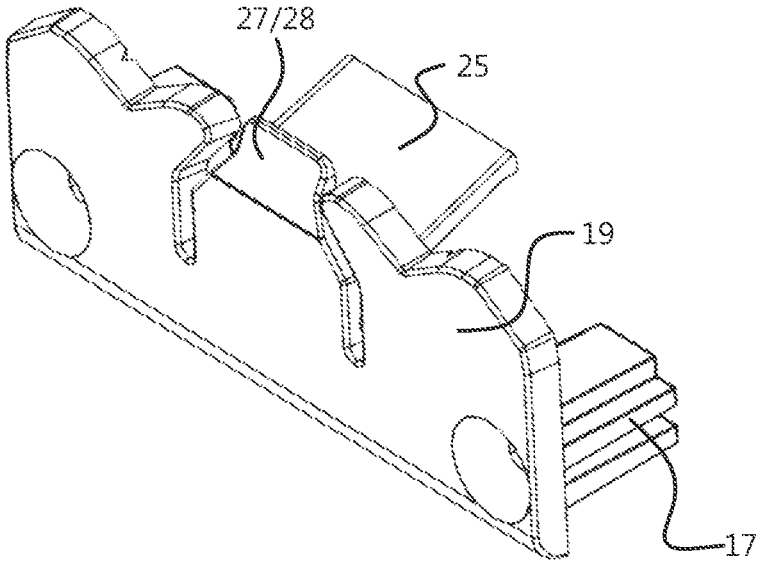

FIGS. 4A-C give perspective views on a separate blocking element 9 according to a possible embodiment of the invention. The blocking element 9 may optionally correspond to any of FIGS. 2A-B and 3A-D.

The blocking element 9 can be coupled to an open end portion 8 of a guiding rail 6. To such end, it comprises two expansion anchors 17, each adapted for receiving a threaded fastener. The expansion anchors 17 are disposed on an inner side (visible in FIGS. 4A and 4B) of the transverse cover 19. They extend into a longitudinal direction w.r.t. the cover 19. Moreover, the blocking element 9 provides a pivotable and/or bendable lip 25 that forms a blocking portion 22. The lip 25 extends inclined but substantially longitudinally, wherein the blocking portion 22 is positioned at an inner side w.r.t. the cover 19. A groove 26 is present near the base of the lip 25. The lip 25 is further provided with a lever 27 having a chamfered edge 28. Only optionally, the blocking element 9 is provided with further plugs 30, equally disposed on the inner side of the cover 19. Such plugs 30 may contribute to the blocking element's 9 coupling.

FIG. 5 illustrates an alternative embodiment of the guiding rail 6 and sliding elements 5. The sliding elements 5 have cuboid engagement portions 14. They may further provide a dunnage support 15 that passes from the guiding channel 10, through a slit opening 11 of the guiding rail 6. The guiding rail 6 does not have an insert 12, however. The sliding elements 5 are directly engaged with the guiding channel 10. The engagement opening 21 is currently arranged as a widening of the slit opening 11. In particular, the engagement opening 21 extends through a front and upper wall of the guiding channel 6. The engagement opening 21 is thus still arranged in a transverse direction (forward and upward) w.r.t the guiding rail 6. The blocking element 9 is further designed as a blocking pin 9. The latter passes through an aperture in the lower wall of the guiding channel 6. It coacts with a spring member 31, via a first abutment portion 32 provided on the pin 9 and a second abutment portion 32' provided on the guiding rail 6. In a first relaxed/blocking position, an upper blocking portion 22 of the blocking pin 9 is positioned upward, and within the guiding channel 10. However, the blocking pin 9 and blocking portion 22 can be moved downward (=away from the engagement opening 21). The resilient force is thereby opposed; the blocking pin 9 is thereby brought into a second tensed/non-blocking position (not shown). For instance, when pushing a separate sliding element 5 down through the engagement opening 21, the blocking portion 22 will automatically move downward; it is automatically brought into its second tensed/non-blocking position. This allows for engaging the sliding element within the guiding channel 10. As soon as the blocking portion 22 has been passed, it will automatically return to its first relaxed/blocking position (shown in FIG. 5).

Figure 6:
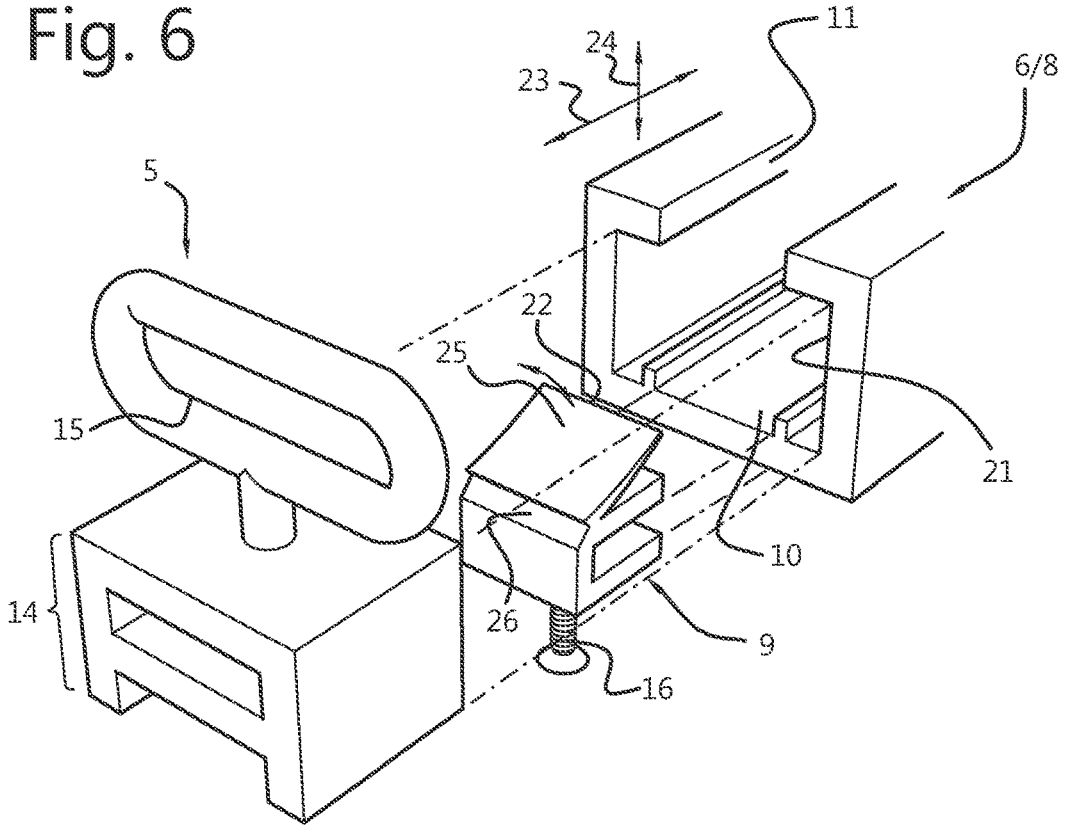
FIG. 6 gives an exploded view on yet an alternative embodiment of the guiding rail and sliding elements.

FIG. 6 gives an exploded view on yet an alternative embodiment of the guiding rail 6. The guiding rail 6 does not have an insert 12. Moreover, the engagement opening 21 is oriented longitudinally 23 instead of transversely 24.

The blocking element 9 features a movable lip 25 that provides a blocking portion 22. A groove 26 is (optionally) provided at the base of the lip 25, such that the lip 25 can be pivoted resiliently. Additionally or alternatively, the lip 25 itself can be bended resiliently. In any case, the blocking portion 22 can be moved resiliently between a first relaxed position and a second tensed position, in a substantially transverse direction 24 w.r.t. the guiding rail 6. The blocking element 9 can further be coupled to the open end portion 8 of the guiding rail 6. To such end, a transverse threaded fastener 16 is provided. Even in the coupled configuration, sliding elements 5 can be slid over the blocking element 9, and past the blocking portion 22. Quite advantageously, the lip 25 and its blocking portion 22 are automatically brought into their second/non-blocking position. Once the blocking element 9 has passed the blocking portion 22, the latter will automatically return to its first/blocking position. The sliding element is now engaged within the guiding channel 10 (not shown). Its provides a support 15 through the slit opening 11 of the guiding rail 6.

The numbered elements on the figures are:

1. Container
2. Bottom
3. Side
4. Dunnage
5. Sliding element
6. Guiding rail
7. Pocket
8. End portion
9. Blocking element
10. Guiding channel
11. Slit opening
12. Insert
13. Insert channel
14. Engagement portion
15. Support
16. Threaded fastener
17. Expansion anchor
18. Anchorage channel
19. Cover
20. Cut-off/Cut-out
21. Engagement opening
22. Blocking portion
23. Longitudinal direction
24. Transverse direction
25. Lip
26. Groove
27. Handle/lever
28. Chamfered edge
29. Screwdriver
30. Plug
31. Spring member
32. Abutment portion It is supposed that the present invention is not restricted to any form of realization described previously and that some modifications can be added to the presented examples and figures, without reappraisal of the appended claims.

The invention claimed is:

1. A guiding rail comprising a guiding channel having a slit opening, which guiding rail is further provided with:

one or more sliding elements engaged with said guiding channel, wherein the one or more sliding elements are able to slide back and forth along said guiding channel while providing a support through the slit opening, suitable for supporting a dunnage structure in a transport and/or storage device; and a blocking element coupled to the guiding rail and arranged at an end of the guiding channel, the blocking element including a resilient blocking portion being pivotable between a first position, where the blocking portion prevents the one or more sliding elements from exiting the guiding channel, and a second position, where the blocking portion exposes an engagement opening through which the one or more sliding elements pass to immediately exit the guiding channel.

2. The guiding rail according to claim 1, wherein the blocking element is adapted for its blocking portion to be movable in a substantially transverse direction with respect to the guiding rail.

3. The guiding rail according to claim 1, wherein the blocking element is adapted for its blocking portion to be resiliently movable between a relaxed position and a tensed position, the blocking element further comprising a groove near the base of the blocking portion to facilitate pivoting of the blocking portion.

4. The guiding rail according to claim 3, wherein the blocking element comprises a resilient member.

5. The guiding rail according to claim 1, wherein the engagement opening is arranged in a transverse direction with respect to the guiding rail.

6. The guiding rail according to claim 1, wherein the engagement opening is arranged as a widening of the slit opening.

7. The guiding rail according to claim 1, wherein the blocking element is adapted for its blocking portion to be resiliently moveable, away from said engagement opening, between a first relaxed position and a second tensed position.

8. The guiding rail according to claim 1, wherein a friction reducing insert is arranged within said guiding channel, and wherein the engagement opening is provided at an end of the friction reducing insert.

9. A container for transport and/or storage of goods, the container comprising:

a bottom and at least two sides, erecting from said bottom;

at least one pair of opposite guiding rails supported by the container sides;

a plurality of sliding elements, engaged with guiding channels formed by said guiding rails; and a dunnage structure that is suspended from the sliding elements, wherein said guiding rails correspond to the guiding rail according to claim 1.

10. A blocking element, suitable for being provided to an open end portion of a guiding rail having a guiding channel, which channel extends into a longitudinal direction of the rail, said blocking element comprising:

a transverse cover for at least partly covering the guiding channel at said open end portion, and a blocking portion arranged at an inner side of the transverse cover and extending into the guiding channel block passage of sliding elements engaged with said channel, the blocking portion being pivotable between a first position, where the blocking portion prevents the sliding elements from exiting the guiding channel, and a second position, where the blocking portion exposes an engagement opening through which the sliding elements pass to immediately exit the guiding channel.

* * * * *